US011130348B2

(12) United States Patent
Sugiyama et al.

(10) Patent No.: US 11,130,348 B2
(45) Date of Patent: Sep. 28, 2021

(54) INKJET PRINTER

(71) Applicant: Roland DG Corporation, Hamamatsu (JP)

(72) Inventors: Yuichi Sugiyama, Hamamatsu (JP); Kei Akiyama, Hamamatsu (JP)

(73) Assignee: Roland DG Corporation, Hamamatsu (JP)

( * ) Notice: Subject to any disclaimer, the term of this patent is extended or adjusted under 35 U.S.C. 154(b) by 0 days.

(21) Appl. No.: 16/887,844

(22) Filed: May 29, 2020

(65) Prior Publication Data

US 2020/0376852 A1 Dec. 3, 2020

(30) Foreign Application Priority Data

May 31, 2019 (JP) ..... JP2019-103039

(51) Int. Cl.
*B41J 2/185* (2006.01)
*B41J 2/165* (2006.01)
*B41J 2/14* (2006.01)

(52) U.S. Cl.
CPC ..... *B41J 2/185* (2013.01); *B41J 2/14* (2013.01); *B41J 2/16523* (2013.01); *B41J 2002/14362* (2013.01); *B41J 2002/16555* (2013.01)

(58) Field of Classification Search
CPC .... B41J 2/175; B41J 2/18; B41J 2002/14362; B41J 2002/16555; B41J 29/13; B41J 29/377; B41J 29/38; B41J 2/14; B41J 2/16523; B41J 2/185; B41J 29/02
See application file for complete search history.

(56) References Cited

U.S. PATENT DOCUMENTS

2003/0156177 A1* 8/2003 Nishikawa ..... B41J 11/002 347/102
2018/0290461 A1* 10/2018 Suzuki ..... B41J 29/13
2019/0100035 A1* 4/2019 Matsuoka ..... B41J 29/377

FOREIGN PATENT DOCUMENTS

JP 5378733 12/2013

* cited by examiner

*Primary Examiner* — Jannelle M Lebron

(74) *Attorney, Agent, or Firm* — Knobbe, Martens, Olson & Bear LLP

(57) ABSTRACT

A printer can comprise an ink head for discharging ink toward a printing medium, and a blowing device for blowing air against the printing medium. The blowing device can comprise a first case that is disposed further rearward, in a direction of movement, than the ink head. The first case can have a first air intake opening for taking in air of the vicinity of the printing medium, a first fan for drawing in air from the first air intake opening and expelling air from a first outlet opening. A second case can be positioned further rearward, in the movement direction Y1, than the first air intake opening, and can have a second air intake opening that opens facing upward and a second fan for drawing in air from the second air intake opening and expelling air toward the printing medium from a second outlet opening. The magnitude of the airflow of the first fan can be less than the magnitude of the airflow of the second fan.

20 Claims, 10 Drawing Sheets

INKJET PRINTER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTIONS

Field of the Technology

The present inventions relate to inkjet printers.

Description of the Related Art

Conventionally, inkjet printers have been known for printing onto printing media using an inkjet system. This type of inkjet printer comprises a platform for placement of a printing medium, and an ink head for discharging ink onto the printing medium that has been placed on the placement platform. Additionally, there are also inkjet printers that are equipped with drying devices, such as heaters, fans, or the like, for drying ink that has been discharged onto the printing medium, depending on the type of ink that is used.

However, when carrying out printing by discharging ink from an ink head onto the printing medium, together with the liquid ink droplets, ink in the form of mist (hereinafter termed "ink mist") that separates off of the ink droplets may also be produced. When compared to the ink droplets, the ink mist is extremely light, and thus becomes airborne in the vicinity of the printing, and may strike the printing medium at a part other than that which is intended. The result is a reduction in the quality of the printed document. Japanese Patent 5378733 describes a printer designed to solve the problem of ink mist noted above, wherein the ink mist that is produced when the ink is discharged from the ink head is removed through suction, and also air is blown against the printing medium to dry the ink.

SUMMARY OF THE INVENTIONS

The inventor in the present application noticed that ink mist can be removed through a relatively gentle convection current of air, and that a relatively large amount of air must be blown toward the printing medium to dry the ink. In the technology described in Japanese Patent 5378733, a single fan is used for both suction of the ink mist and blowing against the printing medium. Because of this, when the air flow of the fan is low, then, despite the ability to remove the ink mist through suction, the air flow can be insufficient to dry the ink thoroughly due to too little air flowing toward the ink that has been discharged onto the printing medium. Moreover, if the air flow of the fan were large, then, despite the ability to remove the ink mist through suction and to dry the ink thoroughly, the ink droplets discharged from the ink head would be affected by the airflow for drawing in the ink mist, which could cause a shift in the locations wherein the ink droplets land.

An aspect of at least one of the inventions disclosed herein includes contemplation of these points, and the object thereof is to provide an inkjet printer that is able to remove appropriately the ink mist that is produced during printing, while also preventing a reduction in quality of the printed document, through promoted drying of the ink.

An inkjet printer according to an embodiment can comprise the following: a placement platform on which a printing medium is placed; an ink head, positioned higher than the placement platform, for discharging ink toward the printing medium that is placed on the placement platform; a carriage on which the ink head is mounted, able to move in a primary scanning direction; and a blowing device, mounted on the carriage, for blowing air against the printing medium. The blowing device can comprise the following: a first case that has a first air intake opening, which faces the printing medium, for taking in air from the vicinity of the printing medium, and a first outlet opening, which is positioned higher than the first air intake opening, for expelling the air that is taken in from the first air intake opening, where the first case is disposed further rearward than the ink head in the direction of movement of the ink head when the ink is discharged toward the printing medium from the ink head; a first fan, provided in the first case, for drawing in air from the first air intake opening and expelling the air from the first outlet opening; a first filter, disposed within the first case so as to be positioned between the first air intake opening and the first outlet opening, through which the air that is drawn in from the first air intake opening passes; a second case, having a second air intake opening that faces upward and a second outlet opening that faces the printing medium and that expels, toward the printing medium, the air taken in from the first air intake opening, where the second case is positioned further rearward, in the direction of movement, than the first air intake open; and a second fan, provided in the second case, for drawing in air from the second air intake opening and expelling the air from the second outlet opening toward the printing medium. In some embodiments, the magnitude of the airflow for the first fan is less than the magnitude of the airflow for the second fan.

In some embodiments, the air in the vicinity of the printing medium is drawn into a first air intake opening by a first fan. While here ink mist may be produced in the vicinity of the printing medium after the ink has been discharged toward the printing medium from the ink head, this mist is drawn in through the first air intake opening. Given this, as the air that is drawn in from the first air intake opening passes through the first filter, mist that is in the air is trapped in the first filter. Because of this, when the air that has passed through the first filter is expelled from the first outlet opening, it will be clean air, from which the airborne ink mist has been reduced. Moreover, because the second air intake opening is an opening that faces upward, air above the second air intake opening is drawn into the second air intake opening by the second fan. That is, air in a location that is away from the vicinity of the printing medium is taken into the second air intake opening. Given this, the air that has been taken in from the second air intake opening is expelled by the second fan from the second outlet opening toward the printing medium. That is, because essentially no ink mist exists in the flow of air toward the printing medium, the ink that has been discharged onto the printing medium can be dried by clean air that includes essentially no effects of ink mist.

Moreover, in some embodiments, the first fan and the second fan are provided independently of each other, enabling an additional, optional configuration in which the magnitudes of the air flows can be set separately for the first fan and the second fan. For example, the magnitude of the air flow of the first fan can be set so as to be less than the magnitude of the air flow for the second fan. That is, having the magnitude of the airflow for the first fan that draws in the ink mist be relatively small makes it possible to draw in the ink mist appropriately while preventing an effect on the discharge direction of the ink that is discharged from the ink head. Moreover, having the magnitude of the airflow for the second fan, which blows air against the printing medium, be relatively large enables promotion of drying of the ink that has been discharged onto the printing medium.

Embodiments disclosed herein can provide an inkjet printer that is able to remove appropriately the ink mist that is produced during printing and also to prevent a reduction in quality of the printed document, through promoting drying of the ink.

BRIEF DESCRIPTIONS OF THE DRAWINGS

DETAILED DESCRIPTION OF THE PREFERRED EMBODIMENTS

An inkjet printer (hereinafter termed "printer") according to an embodiment is explained below with reference to the drawings. Note that, of course, the embodiment explained here is not intended to particularly limit the present inventions disclosed herein. Additionally, members and parts that have identical effects are assigned identical reference symbols, and redundant explanations are omitted or abbreviated, as appropriate.

Figure 1:
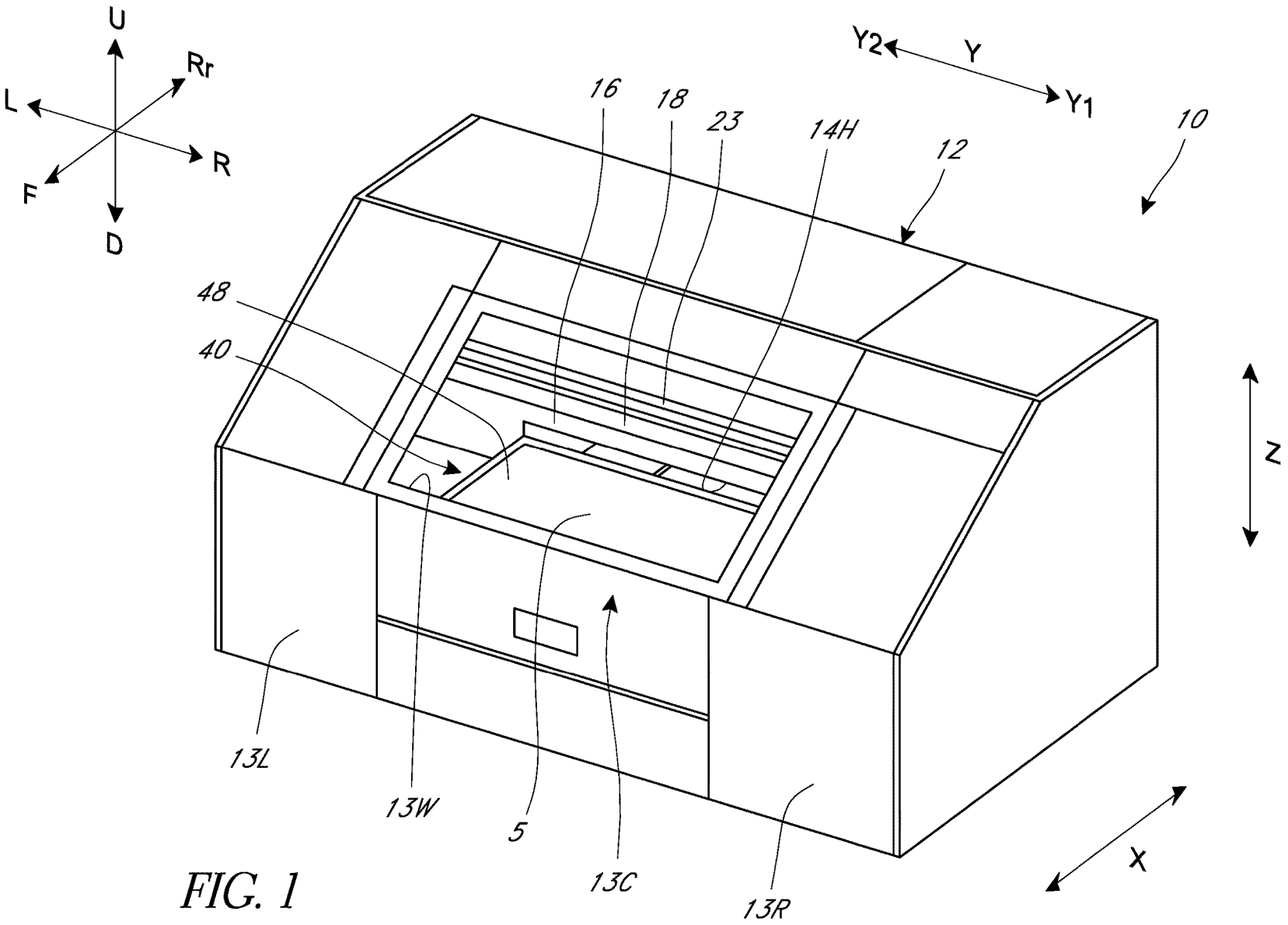
FIG. 1 is a perspective view of a printer according to one embodiment.

FIG. 1 is a perspective view of a printer 10 according to the present embodiment. In the explanation below, the direction away from the printer 10, when the printer 10 is viewed from the front, is defined as "forward," and the direction toward the printer 10 is defined as "rearward." "Left," "right," "up," and "down" have the respective meanings of left, right, up, and down when the printer 10 is viewed from the front. Moreover, in the drawings the reference symbols F, Rr, L, R, U, and D have, respectively, the meanings of front, rear, left, right, up, and down. Furthermore, the reference symbol Y in the drawings indicates the primary scanning direction. Here the primary scanning direction Y is the crosswise direction. Furthermore, in the present embodiment the direction Y1, which is from the left toward the right in the primary scanning direction Y, is the direction of movement (the outbound direction Y1) of the ink head 34 when the ink head 34, described below (referencing FIG. 2) is discharging ink toward the printing medium 5. Furthermore, Y2, which is from the right toward the left in the primary scanning direction Y, is the direction of movement (the return direction Y2) of the ink head 34 when the ink head 34 is not discharging ink toward the printing medium 5. The reference symbol X indicates the secondary scanning direction. Here the second or scanning direction X is the front/rear direction, and, in the plan view, is perpendicular to the primary scanning direction Y. The reference symbol Z indicates the vertical direction. Moreover, the back side of the printer 10 is termed the "downstream side," and the front side of the printer 10 is termed the "upstream side." Note that the directions described above are no more than directions that are established for convenience in explanation, and in no way constrain the form in which the printer 10 is installed, nor limit the present inventions in any way.

The printer 10 is an inkjet-type printer. The printer 10 is a so-called "large printer," wherein the primary scanning direction Y is long when compared to a printer for home use. For example, the printer 10 is a printer for industrial use. In the present embodiment, the printer 10 prints an image onto a printing medium 5.

The printing medium 5 is, for example, printer paper. However, the printing medium 5 is not limited to printer paper. For example, the "printing medium 5" includes sheets formed from resin materials such as polyvinyl chloride (PVC), polyester, or the like, metal plates formed from, for example, aluminum or iron, and materials that are relatively thick, such as sheets of glass, sheets of wood, and so forth.

Figure 2:
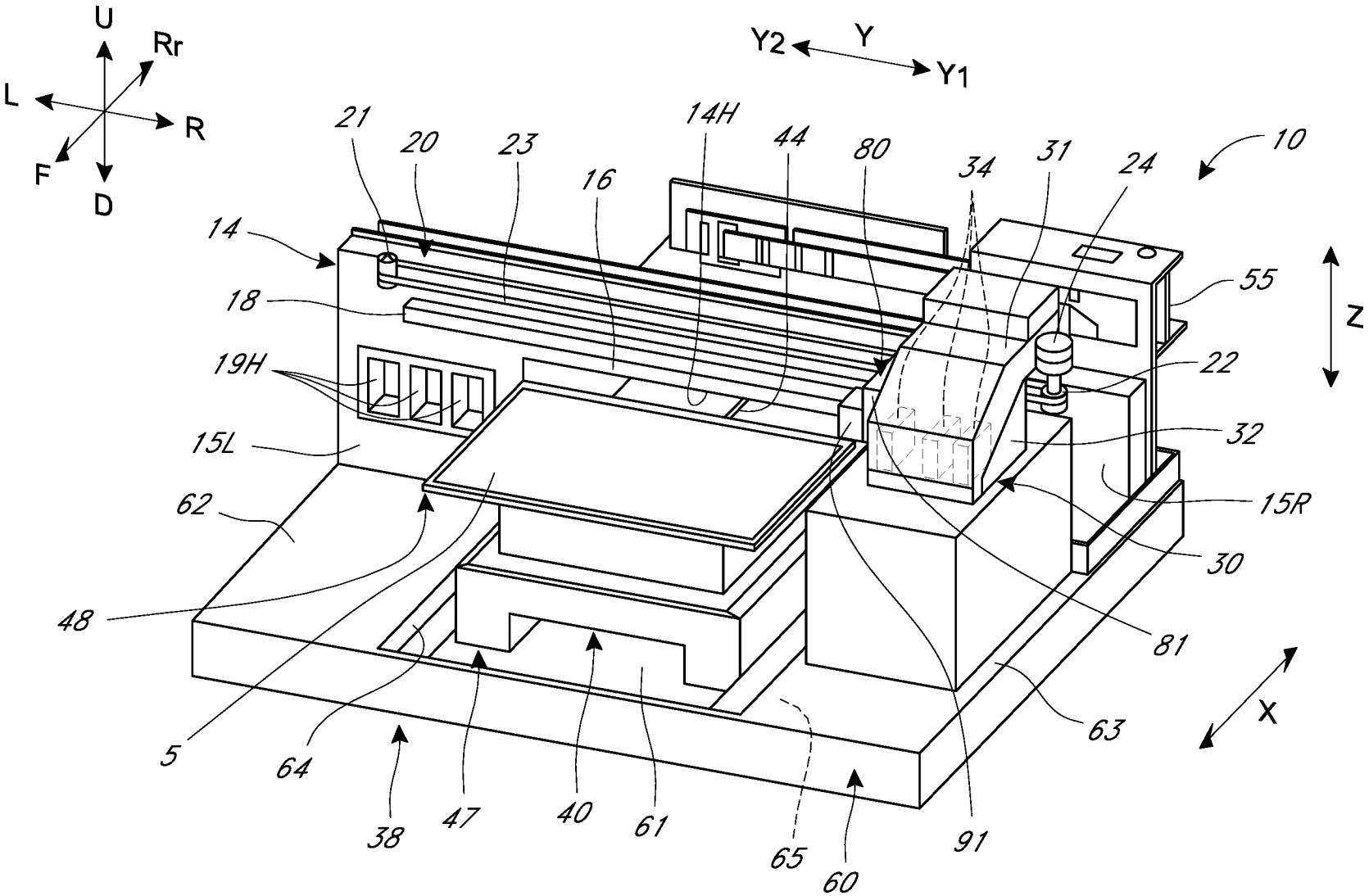
FIG. 2 is a perspective view of a printer in a state wherein the main unit case is removed, according to one embodiment.

As illustrated in FIG. 2, the printer 10 comprises a base member 60, a main unit case 12 (referencing FIG. 1) that is attached to the base member 60, a carriage moving mechanism 20, a table moving mechanism 38, an ink head unit 30, and a controlling device 55. The printer 10 comprises a main unit frame 14 that supports the carriage moving mechanism 20 and the ink head unit 30. The table moving mechanism 38 has a first slide rail 51 (referencing FIG. 4) and a second slide rail 52 (referencing FIG. 4) that support the table unit 40, described below, so as to enable movement in the secondary scanning direction X; a table unit 40 that has a table 48 for placement of the printing medium 5; and a moving device 41 (referencing FIG. 4) for moving the table unit 40 in the secondary scanning direction X. The table 48 is an example of a placement platform.

The ink head unit 30 is disposed on the inside of the main unit case 12. As illustrated in FIG. 2, the ink head unit 3 is disposed higher than the table unit 40. The ink head unit 30 comprises: one or more ink heads 34 (which can also be referred to as a "printheads"), a head carriage 32 on which the ink head 34 is mounted; a damper 37 (referencing FIG. 5) that is provided on the top of the ink head 34; a case 31 that is attached to the head carriage 32; and a blowing device 80 that is installed on the head carriage 32. The head carriage 32 is an example of a carriage.

As illustrated in FIG. 1, a front cover 13C is provided in the center of the front portion of the front unit case 12. A left cover 13L is provided on the left of the front portion of the main unit case 12. A right cover 13R is provided on the right of the front portion of the main unit case 12. The front cover 13C, the left cover 13L, and the right cover 13R are structured so as to be able to open and close in respect to the main unit case 12. A window 13W is provided in the front cover 13C. The window 13W is formed from, for example, the transparent acrylic plate. The operator is able to view the interior of the main unit case 12 through the window 13W. The base member 60 (referencing FIG. 2) is attached to the bottom of the main unit case 12. The base member 60 supports the main unit case 12. The main unit case 12 can be considered as forming an enclosure around the components disposed therein.

As illustrated in FIG. 2, the base member 60 includes: a bottom wall 61 that serves as a structure of the bottom surface; a left wall 62 that is positioned to the left and above the bottom wall 61; a right wall 63 that is positioned to the right and above the bottom wall 61; a left side wall 64 that connects the bottom wall 61 and the left wall 62 and that extends in the vertical direction Z; and a right side wall 65 that connects the bottom wall 61 and the right wall 63 and that extends in the vertical direction Z. The table unit 40 moves in the secondary scanning direction X, over the bottom wall 61. The left wall 62 and the right wall 63 support the main unit frame 14, described below.

Figure 3:
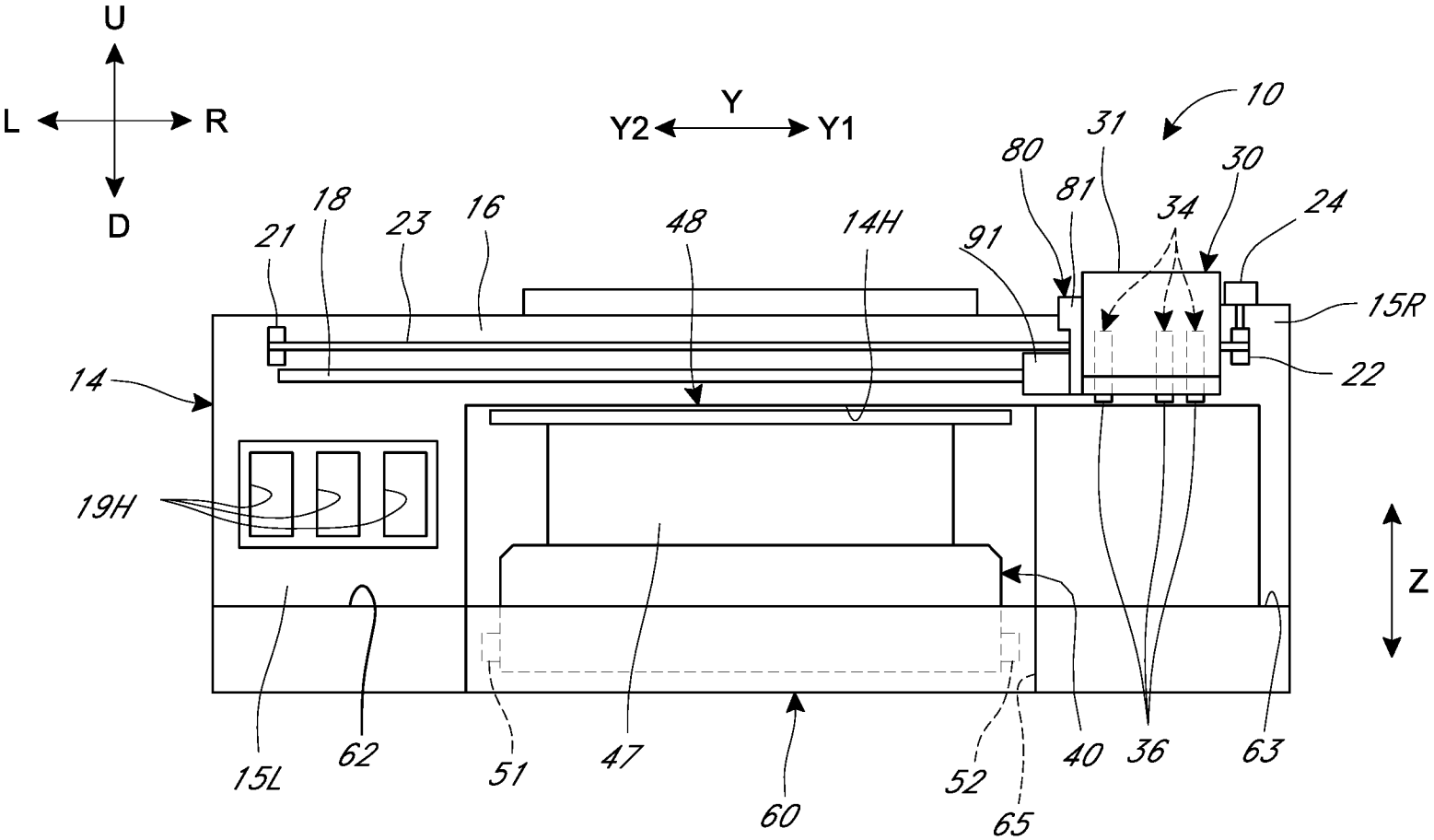
FIG. 3 is a front elevational view of a printer in a state wherein the main unit case is removed, according to one embodiment.

As illustrated in FIG. 3, the main unit frame 14 is provided on the base member 60. The main unit frame 14 comprises: a left base wall 15L that extends upward from the left wall 62 of the base member 60; a right base wall 15R that extends upward from the right wall 63 of the base member 60; and a supporting wall 16 that connects the top end of the left base wall 15L and the top end of the right base wall 15R. The left base wall 15L is positioned further to the left than the table unit 40. The right base wall 15R is positioned further to the right than the table unit 40. The supporting wall 16 extends in the primary scanning direction Y. The supporting wall 16 is disposed higher than the base member 60. In the printer 10, an opening 14H is structured so as to enable the table unit 40 to pass therethrough, passing in the secondary scanning direction X. The opening 14H is formed encompassed by the main unit frame 14 and the base member 60.

As illustrated in FIG. 2, the printer 10 comprises a guide rail 18 that is provided on the supporting wall 16. The guide rail 18 extends in the primary scanning direction Y. The guide rail 18 is provided along the front face of the supporting wall 16. The guide rail 18 is disposed higher than the opening 14H. The guide rail 18 is disposed higher than the table unit 40. The head carriage 32 of the ink head unit 30 is provided slidably on the guide rail 18. The guide rail 18 guides the movement of the head carriage 32 in the primary scanning direction Y.

As illustrated in FIG. 2, the carriage moving mechanism 20 is a mechanism for moving the head carriage 32 in the primary scanning direction Y relative to the printing medium 5 that is placed on the table 48, described below, of the table unit 40. The carriage moving mechanism 20 moves the head carriage 32 in the primary scanning direction Y. Note that there is no particular limitation on the structure of the carriage moving mechanism 20. The carriage moving mechanism 20 comprises a left pulley 21, a right pulley 22, a looped belt 23, and a head carriage motor 24. The left pulley 21 is provided further to the left than the left edge of the guide rail 18. The right pulley 22 is provided further to the right than the right end of the guide rail 18. The left pulley 21 and the right pulley 22 are secured to the supporting wall 16. The belt 23 is looped on the left pulley 21 and the right pulley 22. The head carriage motor 24 is connected to the right pulley 22. However, the head carriage motor 24 may be connected instead to the left pulley 21. Here the head carriage motor 24 is driven to rotate the right pulley 22, to cause the belt 23 to travel between the left pulley 21 and the right pulley 22.

The head carriage 32 is attached to the belt 23. The head carriage 32 engages the guide rail 18 slidably. The head carriage 32 is disposed higher than the table 48. The belt 23 is caused to travel through driving of the head carriage motor 24. In some embodiments, three ink heads 34 and the blowing device 80, are mounted on the head carriage 32, move in the primary scanning direction Y accompanying movement of the head carriage 32 in the primary scanning direction Y.

Figure 8:
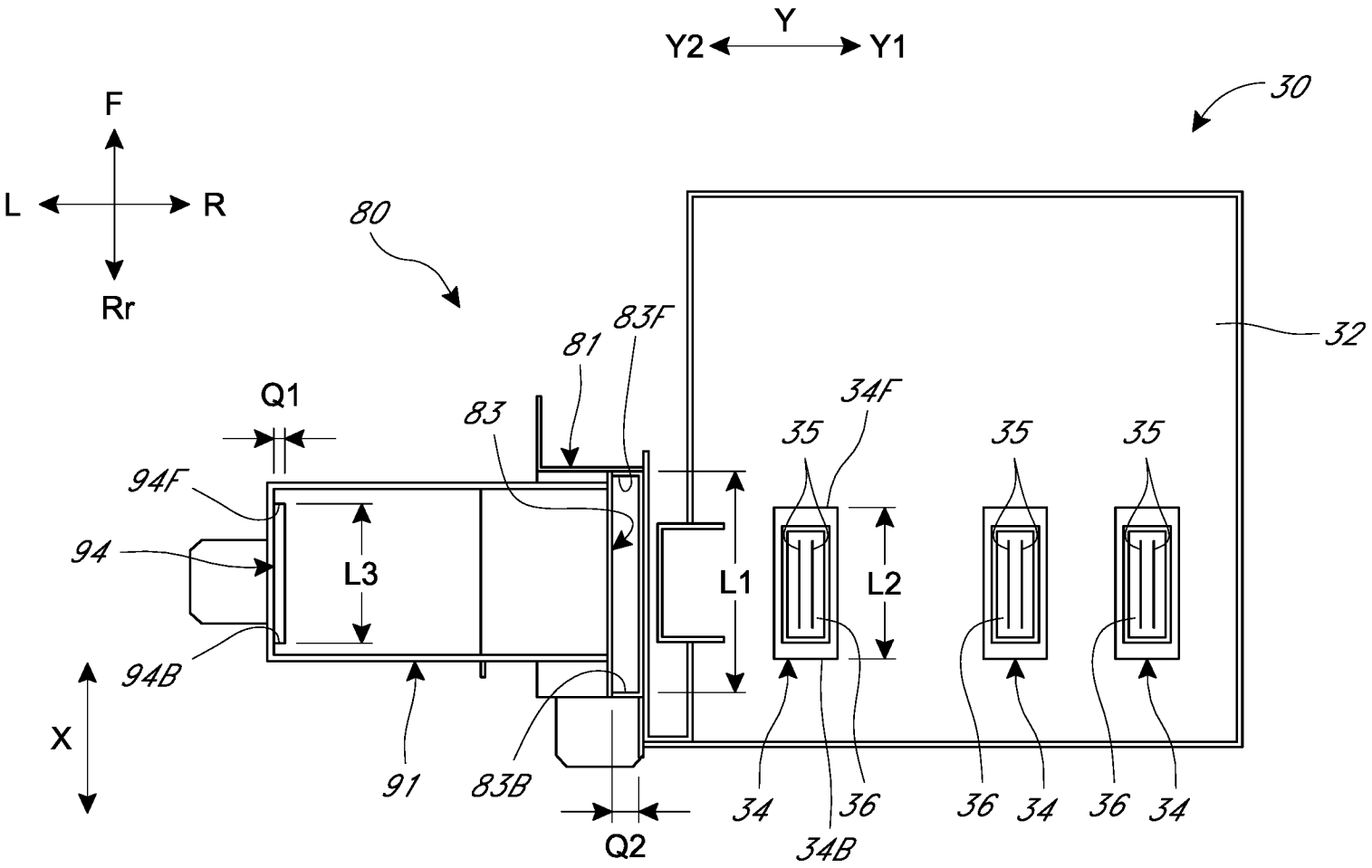
FIG. 8 is a bottom plan view of an ink head unit according to one embodiment.

As illustrated in FIG. 8, the ink heads 34 are formed in a shape wherein the length in the secondary scanning direction X is longer than the length in the primary scanning direction Y. The ink heads 34 are formed so as to have identical shapes and identical sizes. The ink heads 34 each have a plurality of nozzles 35 that are lined up in the secondary scanning direction X, and a nozzle face 36 wherein the plurality of nozzles 35 is formed. In the ink heads 34, two rows of nozzles, structured from the plurality of nozzles 35, are provided. Each nozzle 35 is structured so as to enable discharging of ink onto the printing medium 5 that is placed on the table 48. A negative pressure (a pressure that is lower than the ambient pressure) is set in the nozzle 35. Because each nozzle 35 is extremely small, in FIG. 8, the plurality of nozzles 35 is represented by a straight line. In the present embodiment, the ink head unit 30 is provided with three ink heads 34; however four or more ink heads 34 may be provided instead. Moreover, while each ink head 34 is provided with two rows of nozzles, it may instead be provided with a single row of nozzles, or three or more rows of nozzles. The ink that is discharged from the ink heads 34 may be, for example, a solvent-based pigment ink, or the like, that includes a pigment and a solvent.

Figure 5:
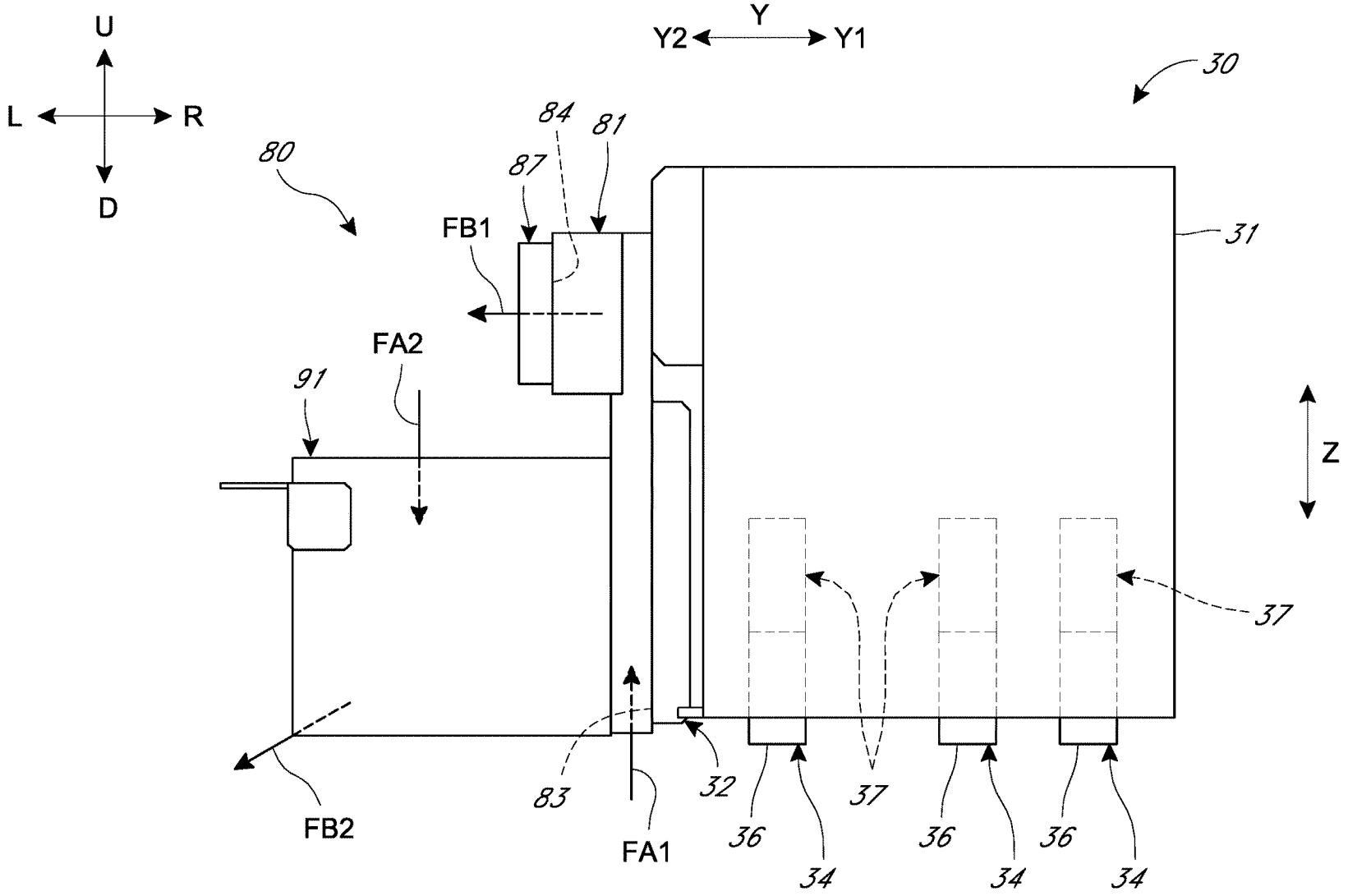
FIG. 5 is a front elevational view of an ink head unit according to one embodiment.

As illustrated in FIG. 5, a damper 37 is provided on the top of each of the ink heads 34. The damper 37 is a member for temporarily storing ink that is supplied from an ink cartridge (not shown). The ink that is stored in the damper 37 is supplied to the ink head 34. Note that the damper 37, for convenience in explanation, is illustrated only in FIG. 5.

The table moving mechanism 38 is a mechanism for moving the table 48 of the table unit 40 in the secondary scanning direction X. As illustrated in FIG. 3, the table unit 40 comprises a table carriage 47 and a table 48 that is provided on the top of the table carriage 47. The table carriage 47 is formed in a box shape. The table carriage 47 is supported on the first slide rail 51 (referencing also FIG. 4) and the second slide rail 52 (referencing also FIG. 4). Note that the table carriage 47 is structured so as to enable movement thereof in the vertical direction Z by a mechanism that is not shown. That is, the table carriage 47 can move the table 48 in the vertical direction.

As illustrated in FIG. 2, the printing medium 5 is placed on the table 48. The table 48 is formed in a rectangle wherein the length in the secondary scanning direction X is shorter than the length in the primary scanning direction Y. Note that in the table 48, the length in the secondary scanning direction X may instead be longer than the length in the primary scanning direction Y, or the length in the secondary scanning direction X may be identical to the length in the primary scanning direction Y. As illustrated in FIG. 3, the table 48 is disposed lower than the supporting wall 16. The table 48 is disposed lower than the ink head unit 30. The table 48 is structured so as to enable movement thereof in the secondary scanning direction X by a moving device 41 (referencing FIG. 4).

Figure 4:
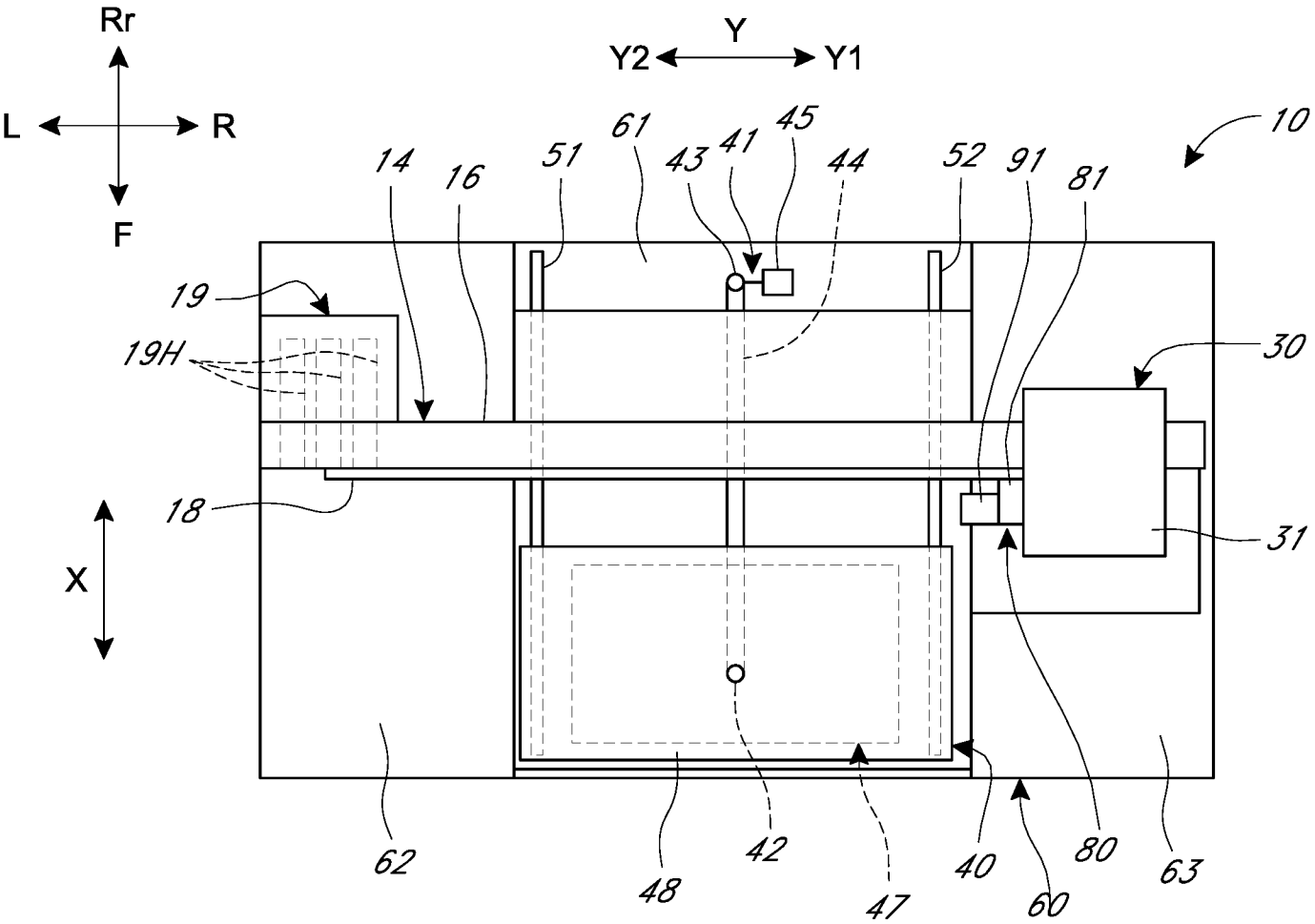
FIG. 4 is top plan view of a printer in a state wherein the main unit case is removed, according to one embodiment.

As illustrated in FIG. 4, the moving device 41 is disposed on the base member 60. The moving device 41 comprises a front pulley 42, a back pulley 43, a looped belt 44, and a driving motor 45. The front pulley 42 is provided on the front side of the bottom wall 61 of the base member 60. The back pulley 43 is provided on the back side of the bottom wall 61. The belt 44 is looped on the front pulley 42 and the back pulley 43. A driving motor 45 is connected to the back pulley 43. The driving motor 45 may be connected to the front pulley 42 instead. Here the driving motor 45 is driven to rotate the back pulley 43, to thereby cause the belt 44 to travel between the front pulley 42 and the back pulley 43. The table carriage 47 of the table unit 40 is attached to the belt 44. Because of this, when the belt 44 is caused to travel by driving of the driving motor 45, the table unit 40 will move in the secondary scanning direction X along the first slide rail 51 and the second slide rail 52. That is, the moving device 41 is able to move the table 48 in the secondary scanning direction X. Note that, for convenience in explanation, the depiction of the carriage moving mechanism 20 is omitted from FIG. 4.

As illustrated in FIG. 4, the printer 10 comprises an ink cartridge storing portion 19 that contains an ink cartridge (not shown). The ink cartridge stores ink. The ink cartridge is connected through the damper 37 (referencing FIG. 5) to the ink head 34 (referencing FIG. 5). The ink cartridge storing portion 19 is provided on the left wall 62 of the base member 60. In the present embodiment, three ink cartridge storing portions 19 are provided lined up along the primary scanning direction Y. Note that the number of ink cartridge storing portions 19 is not limited to 3. As illustrated in FIG. 3, the ink cartridge is structured so as to be inserted into the ink cartridge storing portion 19 through an opening 19H that is formed in the left base wall 15L of the main unit frame 14. In some embodiments, the ink cartridge storing portion 19 can include a plurality of openings 19H; three are illustrated in the embodiment of FIG. 4.

The blowing device 80 is explained below with reference to FIG. 5. The blowing device 80 is a device for blowing air against the printing medium 5. As illustrated in FIG. 5, the blowing device 80 is disposed further to the left than the ink head 34. That is, the blowing device 80 is disposed behind the ink head 34 in the outbound direction Y1. The blowing device 80 comprises a first case 81 that is attached to the head carriage 32, a first fan 87 that is provided on the first case 81, a first filter 88 (referencing FIG. 9) that is disposed within the first case 81, a second case 91 that is attached to the first case 81, a second fan 97 (referencing FIG. 9) that is provided in the second case 91, and a second filter 98 (referencing FIG. 9) that is disposed within the second case 91.

Figure 9:
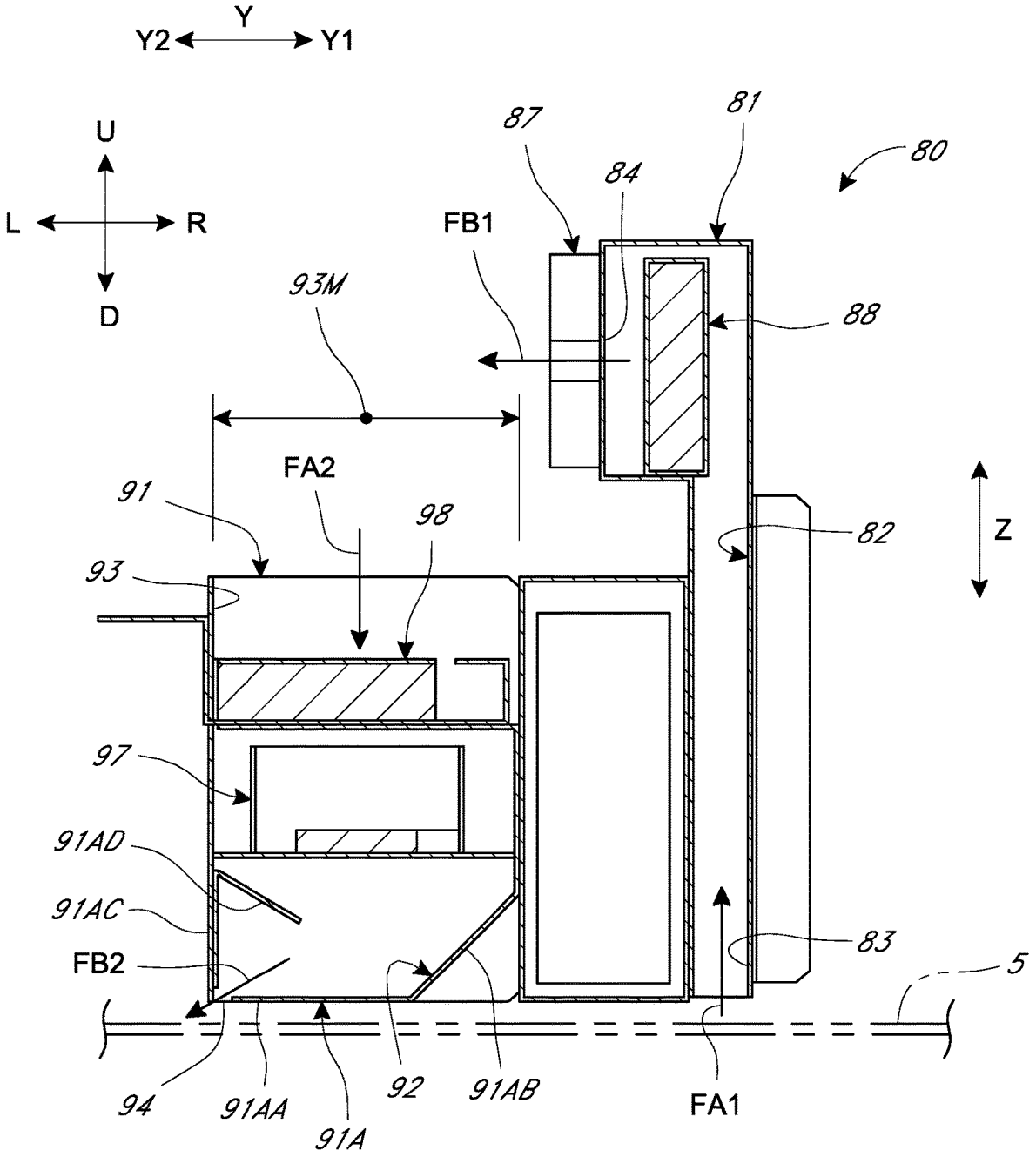
FIG. 9 is a cross-sectional drawing of the ink head unit, taken along the section IX-IX in FIG. 7.

As illustrated in FIG. 5, the first case 81 is disposed further to the left than the ink head 34. That is, the first case 81 is disposed behind the ink head 34 in the outbound direction Y1. As illustrated in FIG. 9, the first case 81 is formed in a box shape that has a first airflow path 82. The first case 81 has a first air intake opening 83, for taking in air from the vicinity of the printing medium 5, and a first outlet opening 84 for expelling the air that was taken in from the first air intake opening 83. The first airflow path 82 connects the first air intake opening 83 and the first outlet opening 84.

As illustrated in FIG. 9, the first air intake opening 83 faces the printing medium 5 (referencing FIG. 2 as well). The first air intake opening 83 is formed at the bottom of the first case 81. As illustrated in FIG. 5, the first air intake opening 83 is positioned higher than the nozzle face 36 of the ink head 34.

As illustrated in FIG. 8, the length L1, in the secondary scanning direction X, of the first air intake opening 83 is longer than the length L2, in the secondary scanning direction X, of the ink head 34. The end portion 83F on the upstream side of the first air intake opening 83 in the secondary scanning direction X is positioned further toward the upstream side (which here is toward the front) than the end portion 34F on the upstream side of the ink head 34.

The end portion 83B on the downstream side of the first air intake opening 83 in the secondary scanning direction X is positioned further toward the downstream side (which here is toward the rear) than the end portion 34B on the downstream side of the ink head 34.

In the present embodiment, the direction FA1 along which the air is drawn in through the first air intake opening 83, as illustrated in FIG. 9, is perpendicular to the printing medium 5. The air in the vicinity of the printing medium 5 is drawn in the upward direction through the first air intake opening 83.

As illustrated in FIG. 9, the first outlet opening 84 is positioned higher than the first air intake opening 83. The first outlet opening 84 is positioned further toward the left than the first air intake opening 83 (behind the ink head 34 in the movement direction Y1). The first outlet opening 84 is formed in the top of the first case 81. As illustrated in FIG. 5, the first outlet opening 84 is positioned higher than the ink head 34. In some embodiments, the first outlet opening 84 is also positioned higher than the damper 37. In some embodiments, the first outlet opening 84 is also positioned higher than the second case 91. In the present embodiment, the direction FB1 in which the air is expelled from the first outlet opening 84, as illustrated in FIG. 9, is parallel to the printing medium 5 (that is, is in the horizontal direction). The air that is drawn into the first air intake opening 83 is expelled toward the left side from the first outlet opening 84 (further rearward than the ink head 34 in the movement direction Y1).

As illustrated in FIG. 5, the first fan 87 is provided so as to cover the first outlet opening 84.

Figure 7:
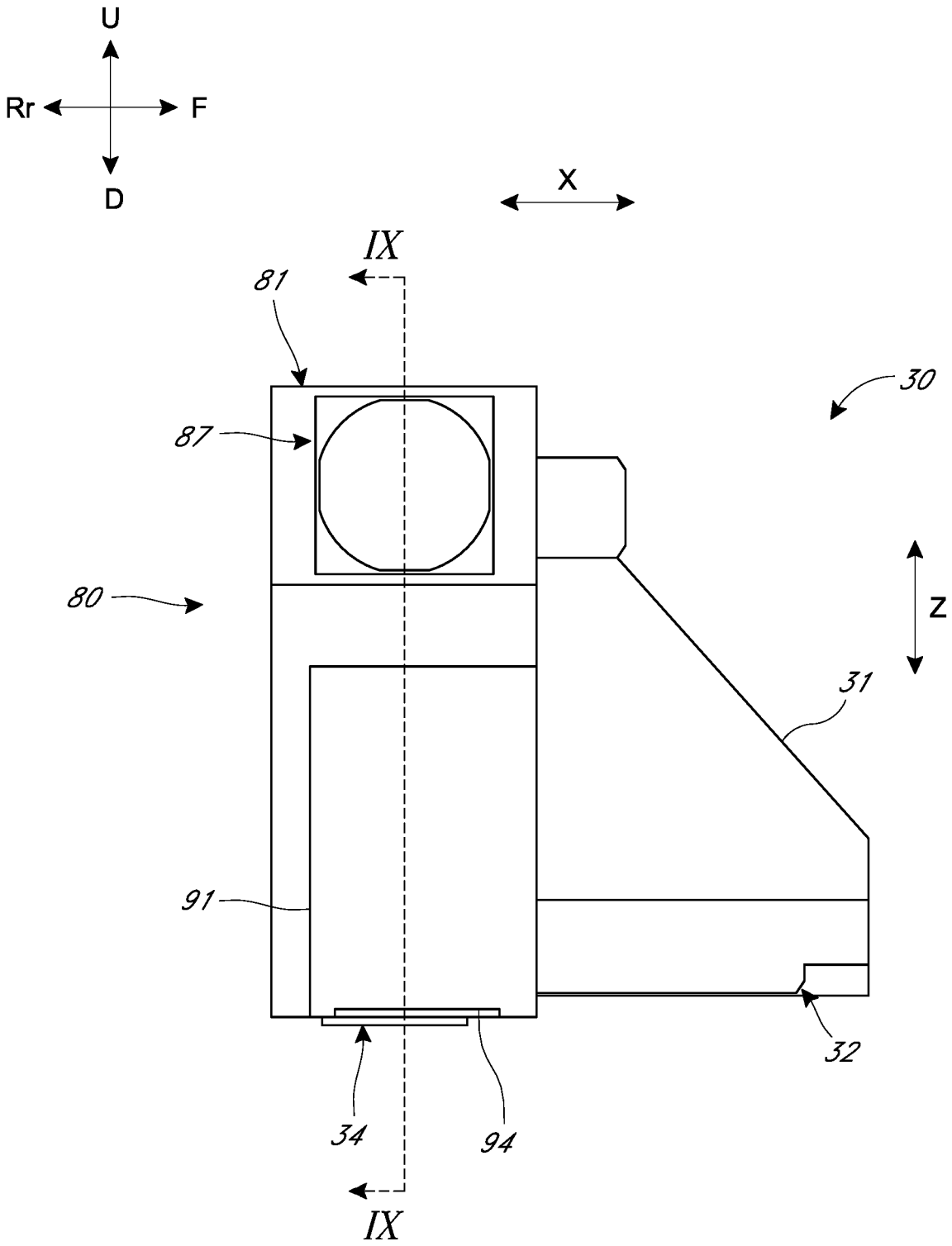
FIG. 7 is a left side elevational view of an ink head unit according to one embodiment.

As illustrated in FIG. 7, the first fan 87 is disposed higher than the second case 91. The first fan 87 draws in air from the first air intake opening 83 and expels air from the first outlet opening 84. The first fan 87 is provided on the outside of the first case 81, but can instead be provided within the first case 81.

As illustrated in FIG. 9, a first filter 88 is disposed in the first airflow path 82 of the first case 81. That is, the first filter 88 is positioned between the first air intake opening 83 and the first outlet opening 84. The first filter 88 is disposed higher than the second case 91. The first filter 88 is installed removably in the first case 81. The air that is drawn in from the first air intake opening 83 passes through the first filter 88. The first filter 88 is formed in a porous shape that enables air to pass therethrough, but that traps the ink mist.

As illustrated in FIG. 5, the second case 91 is disposed further to the left than the first air intake opening 83.

That is, the second case 91 is disposed further to the rear, in the outbound direction Y1, than the first air intake opening 83. As illustrated in FIG. 9, the second case 91 is formed in a box shape that has a second airflow path 92. The second case 91 has a second air intake opening 93 that is open in the upward direction, and a second outlet opening 94 that expels, toward the printing medium 5, the air that is taken in through the second air intake opening 93. The second airflow path 92 connects the second air intake opening 93 and the second outlet opening 94. The second case 91 has a guide plate 91A that directs, to the second outlet opening 94, air that flows from the second fan 97.

The guide plate 91A can have the following: a first part 91AA that extends in the horizontal direction; a second part 91AB that extends upward, angled to the right, from the right end of the first part 91AA; a third part 91AC that extends in the vertical direction; and a fourth part 91AD that extends downward, and angled toward the right, from the top end of the third part 91AC. The second outlet opening 94 is formed between the first part 91AA and the third part 91AC. The second part 91AB has the function of directing, to the second outlet opening 94, air that flows from the second fan 97. The fourth part 91AD has the function for suppressing a counter-current of the air.

As illustrated in FIG. 9, the second air intake opening 93 is formed at the top of the second case 91. The second air intake opening 93 is formed lower than the first outlet opening 84. The second air intake opening 93 is formed higher than the first air intake opening 83. The second air intake opening 93 is formed at a position that is behind the first outlet opening 84 in the direction of movement Y1 (which here is to the left).

Figure 6:
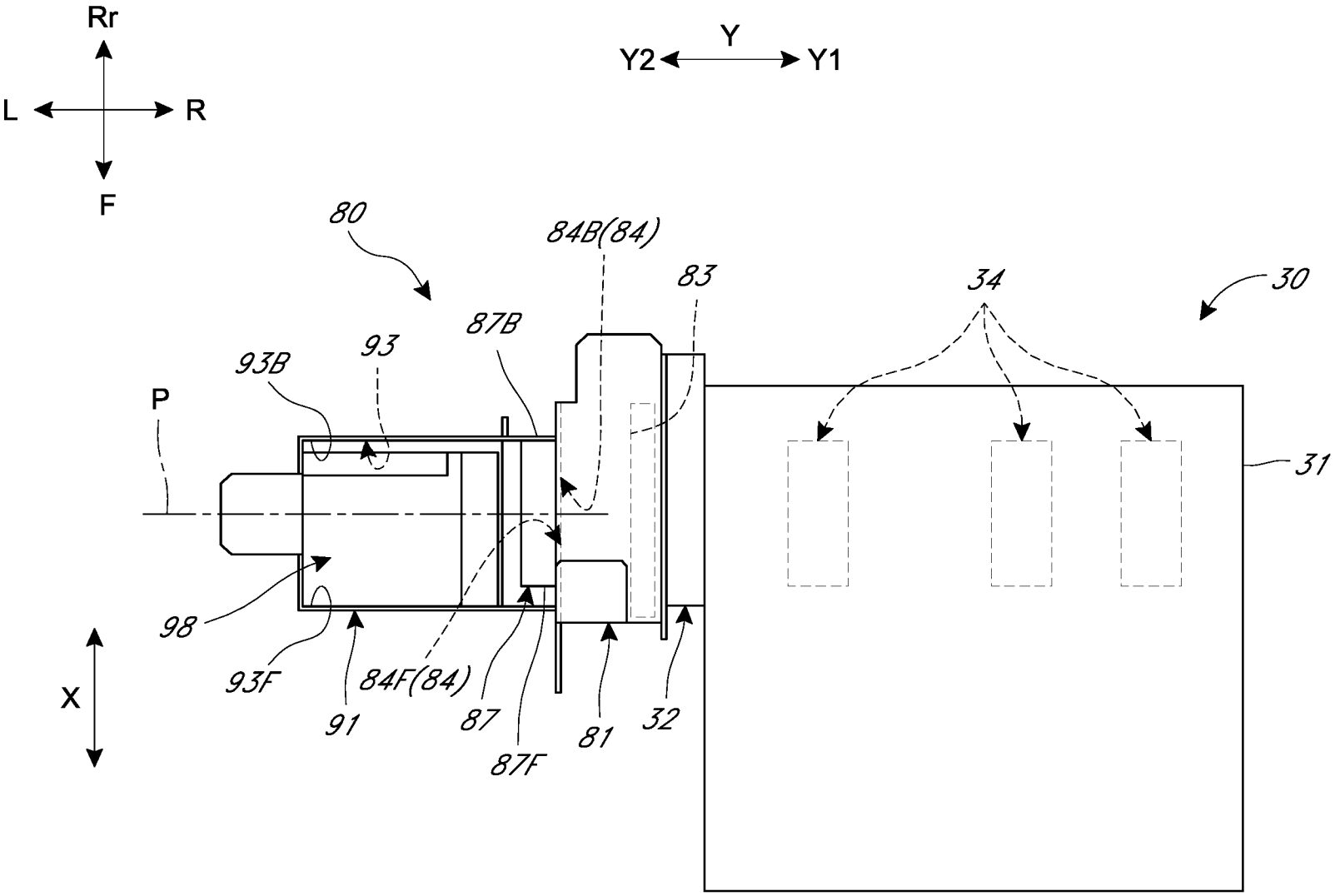
FIG. 6 is a top plan view of an ink head unit according to one embodiment.

As illustrated in FIG. 6, a line P that passes through the center of the first outlet opening 84 overlaps the second air intake opening 93 in the plan view. The end portion 93F that is on the upstream side of the second air intake opening 93 in the secondary scanning direction X is positioned further toward the upstream side than the end portion 84F on the upstream side of the first outlet opening 84 (which here is toward the front). The end portion 93B on the downstream side, in the secondary scanning direction X, of the second air intake opening 93 is positioned further toward the downstream side than the end portion 84B on the downstream side of the first outlet opening 84 (which here is toward the rear). The end portion 93F of the second air intake opening 93 is further toward the upstream side than the end portion 87F on the upstream side of the first fan 87 (which here is toward the front). The end portion 93B of the second air intake opening portion 93 is at a position that is further toward the downstream side than the end portion 87B on the downstream side of the first fan 87 (which here is toward the back). The opening area of the second air intake opening 93 is larger than the opening area of the first air intake opening 83.

In the present embodiment, the direction FA2 in which the air is drawn in through the second air intake opening 93, as illustrated in FIG. 9, is perpendicular to the printing medium 5. Air from above the second air intake opening 93 is drawn in, in the downward direction, from the second air intake opening 93. Moreover, at least a portion of the air that is expelled from the first outlet opening 84 may be drawn in through the second air intake opening 93.

As illustrated in FIG. 9, the second outlet opening 94 is positioned lower than the second air intake opening 93. The second outlet opening 94 faces the printing medium 5. The second outlet opening 94 is positioned further to the left than the center position 93M of the second air intake opening 93 in the primary scanning direction Y (further to the rear than the center position 93M in the direction of movement Y1). The second outlet opening 94 is formed a lower part of the second case 91. In the present embodiment, the direction FB2 in which the air is expelled in the second outlet opening 94 is in a direction away from the ink head 34 (which here is to the left), and downward. The air that is drawn in through the second air intake opening 93 is expelled downward, angled to the left, from the second outlet opening 94 (downward and angled further to the rear, in the direction of movement Y1, than the ink head 34).

As illustrated in FIG. 8, the length L3 of the second outlet opening 94 in the secondary scanning direction X is longer than the length L2 of the ink head 34 in the secondary scanning direction X. The end portion 94F on the upstream side, in the secondary scanning direction X, of the second outlet opening 94 is positioned further toward the upstream side than the nozzle, of the nozzles 35, that is positioned furthest toward the upstream side (which here is toward the front). The end portion 94B on the downstream side, in the secondary scanning direction X, of the second outlet opening 94 is positioned further toward the downstream side than the nozzle, of the nozzles 35, that is positioned furthest toward the downstream side (which here is toward the back). The length L3 of the second outlet opening 94 in the secondary scanning direction X is shorter than the length L1 of the first air intake opening 83 in the secondary scanning direction X. The opening width Q1 (that is, the length in the primary scanning direction Y) of the second outlet opening 94 is shorter than the opening width Q2 (that is, the length in the primary scanning direction Y) of the first air intake opening 83. The end portion 94F of the second outlet opening 94 is positioned further toward the downstream side than the end portion 83F on the upstream side of the first air intake opening 83 (which here is toward the rear). The end portion 94B of the second outlet opening 94 is positioned further toward the upstream side than the end portion 83B on the downstream side of the first air intake opening 83 (which here is toward the front).

As illustrated in FIG. 9, the second fan 97 is disposed within the second case 91. The second fan 97 is disposed lower than the second air intake opening 93. The second fan 97 draws in air from the second air intake opening 93 and expels air from the second outlet opening 94 toward the printing medium 5. The second fan 97 blows air from the second outlet opening 94 toward the printing medium 5. The second fan 97 is disposed within the second case 91, but may instead be provided on the outside of the second case 91 so as to block the second air intake opening 93.

In some embodiments, the magnitude of the airflow for the first fan 87 may be less than the magnitude of the airflow for the second fan 97. The magnitude of the airflow for the second fan 97 is, for example, between about 1.5× and 5× the magnitude of the airflow for the first fan 87. A second filter 98 is provided in the second airflow path 92 of the second case 91. That is, the second filter 98 is positioned between the second air intake opening 93 and the second outlet opening 94. The second filter 98 is disposed higher than the second fan 97. The second filter 98 is installed removably in the second case 91. The air drawn in from the second air intake opening 93 passes through the second filter 98. The second filter 98 may be the same as the first filter 88.

A controlling device 55 is a device for controlling printing onto the printing medium 5. There is no particular limitation on the structure of the controlling device 55. The controlling device 55 is, for example, a microcomputer. While there is no particular limitation on the hardware structure of the microcomputer, it may, for example, comprise an interface, a CPU, a ROM, a RAM, and a storing device. As illustrated in FIG. 2, the controlling device 55 is provided in the main unit frame 14. The controlling device 55 is connected to, and controls, the head carriage motor 24, the ink head 34, the driving motor 45, the first fan 87 and the second fan 97 of the blowing device 80. The controlling device 55 controls the magnitude of the airflow, the timing of the driving, and the like, for the first fan 87 and the second fan 97.

The operation of the blowing device 80 during printing onto the printing medium 5 is explained below. When the head carriage 32 is moved in the outbound direction Y1 and ink is discharged toward the printing medium 5 from the nozzle 35 of the ink head 34, the first fan 87 and second fan 97 of the blowing device 80 are driven. When ink is discharged from the ink head 34 toward the printing medium 5, ink mist may be produced in the vicinity of the printing medium 5. Through the driving of the first fan 87, the ink mist in the vicinity of the printing medium 5 is drawn in through the first air intake opening 83, to be trapped in the first filter 88.

Moreover, through driving of the second fan 97, air that includes essentially none of the ink mist, that is present above the second case 91, is drawn in through the second air intake opening 93, and is blown from the second outlet opening 94 toward the printing medium 5. Drying of the ink that has been discharged onto the printing medium 5 is promoted thereby.

On the other hand, when the head carriage 32 is moved in the return direction Y2, no ink is discharged from the nozzle 35 of the ink head 34 toward the printing medium 5, and thus the first fan 87 and the second fan 97 of the blowing device 80 are not driven. Note that, instead, the first fan 87 and the second fan 97 of the blowing device 80 may also be driven as the head carriage 32 is moving in the return direction Y2. This makes it possible to further blow air toward the printing medium 5, enabling more reliable drying of the ink that is discharged toward the printing medium 5.

As described above, given the printer 10 according to the present embodiment, air in the vicinity of the printing medium 5 is taken in through the first air intake opening 83 by the first fan 87. While here ink mist is produced in the vicinity of the printing medium 5 after ink has been discharged toward the printing medium 5 by the ink head 34, this ink mist is drawn in through the first air intake opening 83. Given this, as the air that has been drawn in through the first air intake opening 83 passes through the first filter 88, mist that is in the air is trapped in the first filter 88. Because of this, when the air that has passed through the first filter 88 is expelled from the first outlet opening 84, it will be clean air, from which the airborne ink mist has been reduced.

Moreover, because the second air intake opening 93 is an opening that faces upward, air that is above the second air intake opening 93 is drawn into the second air intake opening 93 by the second fan 97. That is, air that is positioned away from the vicinity of the printing medium 5 is taken in from the second air intake opening 93. Given this, the air that is taken in from the second air intake opening 93 is expelled from the second outlet opening 94 toward the printing medium 5 by the second fan 97. That is, because essentially no ink mist exists in the air that flows toward the printing medium 5, this enables the ink that has been discharged onto the printing medium 5 to be dried by clean air that is essentially unaffected by the ink mist. Moreover, because the first fan 87 and the second fan 97 are each provided independently, the magnitudes of the airflows can be set separately for the first fan 87 and the second fan 97.

In some embodiments, the magnitude of the airflow of the first fan 87 can optionally be set so as to be less than the magnitude of the airflow of the second fan 97. That is, because the magnitude of the airflow of the first fan 87, for drawing in the ink mist, is relatively small, this enables the ink mist to be drawn in appropriately while preventing effects on the direction of discharge of the ink that is discharged from the ink head 34. Moreover, through having the magnitude of the airflow of the second fan 97, which blows air against the printing medium 5, be relatively large, this can promote drying of the ink that has been discharged onto the printing medium 5.

In the printer 10 according some embodiments, the blowing device 80 is provided with a second filter 98 that is positioned in the second case 91 so as to be positioned between the second air intake opening 93 and the second outlet opening 94, and through which the air that has been drawn into the second air intake opening 93 passes. Through this, air that is cleaner will flow from the second outlet opening 94, enabling the ink that has been discharged onto the printing medium 5 to be dried by clean air that is unaffected by the ink mist.

In the printer 10 according to some embodiments, the first outlet opening 84 is positioned higher than the ink head 34. This enables control of the flow, toward the ink that has been discharged from the ink head 34, of the air that is expelled from the first outlet opening 84.

In the printer 10 according to some embodiments, a damper 37, for storing the ink temporarily, is provided on the top of the ink head 34. The first outlet opening 84 is positioned higher than the damper 37. This enables greater control of the flow of the air that is expelled from the first outlet opening 84 toward the ink that is discharged from the ink head 34.

In the printer 10 according some embodiments, the length L1 of the first air intake opening 83 in the secondary scanning direction X is longer than the length L2 of the ink head 34 in the secondary scanning direction X. This enables more reliable suction, from the first air intake opening 83, of the ink mist in the vicinity of the printing medium 5 that is produced after the ink is discharged from the ink head 34 toward the printing medium 5.

In the printer 10 according to some embodiments, the length L3 of the second outlet opening 94 in the secondary scanning direction X is longer than the length L2 of the ink head 34 in the secondary scanning direction X. This enables air to be blown across a wider range of the ink that has been discharged onto the printing medium 5.

In the printer 10 according to some embodiments, the second air intake opening 93 is positioned lower than the first outlet opening 84 and further rearward than the first outlet opening 84 in the direction of movement Y1. A line P that passes through the center of the first outlet opening 84 overlaps the second air intake opening 93 in the plan view. Through this, at least a portion of the air that has passed through the first air filter 88 and been expelled from the first outlet opening 84 will be drawn in through the second air intake opening 93. Because air that has passed through the first filter 88 is drawn into the second air intake opening 93, cleaner air can be expelled from the second outlet opening 94.

In the printer 10 according to some embodiments, the end portion 93F on the upstream side, in the secondary scanning direction X, of the second air intake opening 93 is positioned further to the upstream side, in the secondary scanning direction X, than the end portion 84F on the upstream side, in the secondary scanning direction X, of the first outlet opening 84, and the end portion 84B on the downstream side, in the secondary scanning direction X, of the second air intake opening 93 is positioned further to the downstream side, in the secondary scanning direction X, than the end portion 84F on the upstream side, in the secondary scanning direction X, of the first outlet opening 84. Through this, most of the air that has passed through the first air filter 88 and been expelled from the first outlet opening 84 will be drawn in through the second air intake opening 93.

In the printer 10 according to some embodiments, the direction FA1 in which the air is drawn into the first air intake opening 83 is perpendicular to the printing medium 5. This makes it possible to prevent more fully any the shift in the ink landing position due to the airflow that is produced when air is drawn into the first air intake opening 83.

In the printer 10 according to some embodiments, the direction FB2 with which air is expelled from the second outlet opening 94 is in a direction away from the ink head 34, in the primary scanning direction Y (which here is to the left) and downward. This can prevent more fully any shift in landing position of the ink caused by the air that is expelled from the second outlet opening 94 when air is blown against the printing medium 5.

An ideal embodiment according the present invention has been explained above. However, each embodiment described above is no more than illustrative, and the present inventions may be carried out in a variety of other forms.

In the printer 10, described above, the blowing device 80 may comprise a heating mechanism, disposed within the second case 91, for heating the air that will be expelled from the second outlet opening 94. The heating mechanism may be provided, for example, on the upstream side of the second fan 97 (which here is toward the top), or provided on the downstream side thereof (which here is toward the bottom). The amount of heat produced by the heating mechanism, and the like, is controlled by the controlling device 55. The heating mechanism may be, for example, a nichrome wire heater, or the like. This enables heated air to be blown against the printing medium 5, enabling greater promotion of drying of the ink that is discharged onto the printing medium 5.

While, in the embodiment set forth above, the direction FA1 for drawing in air through the first air intake opening 83 is perpendicular to the printing medium 5, there is no limitation thereto. The direction FA1 for drawing in air may be in a direction away from the ink head 34 and downward (which here is downward, angled to the left), or a direction toward the ink head 34 and downward (which here is downward, angled to the right). Moreover, while the direction FB2 for expelling air from the second outlet opening 94 was in a direction away from the ink head 34 and downward (which here was downward, angled toward the left), there is not limitation thereto. The direction FB2 for expelling the air may instead be perpendicular to the printing medium 5, or may be in a direction toward the ink head 34 and downward (which here is downward, angled toward the right).

While in the embodiment set forth above, the structure was such that ink is discharged toward the printing medium 5 from the ink head 34 only during movement in the outbound direction Y1, there is no limitation thereto.

Figure 10:
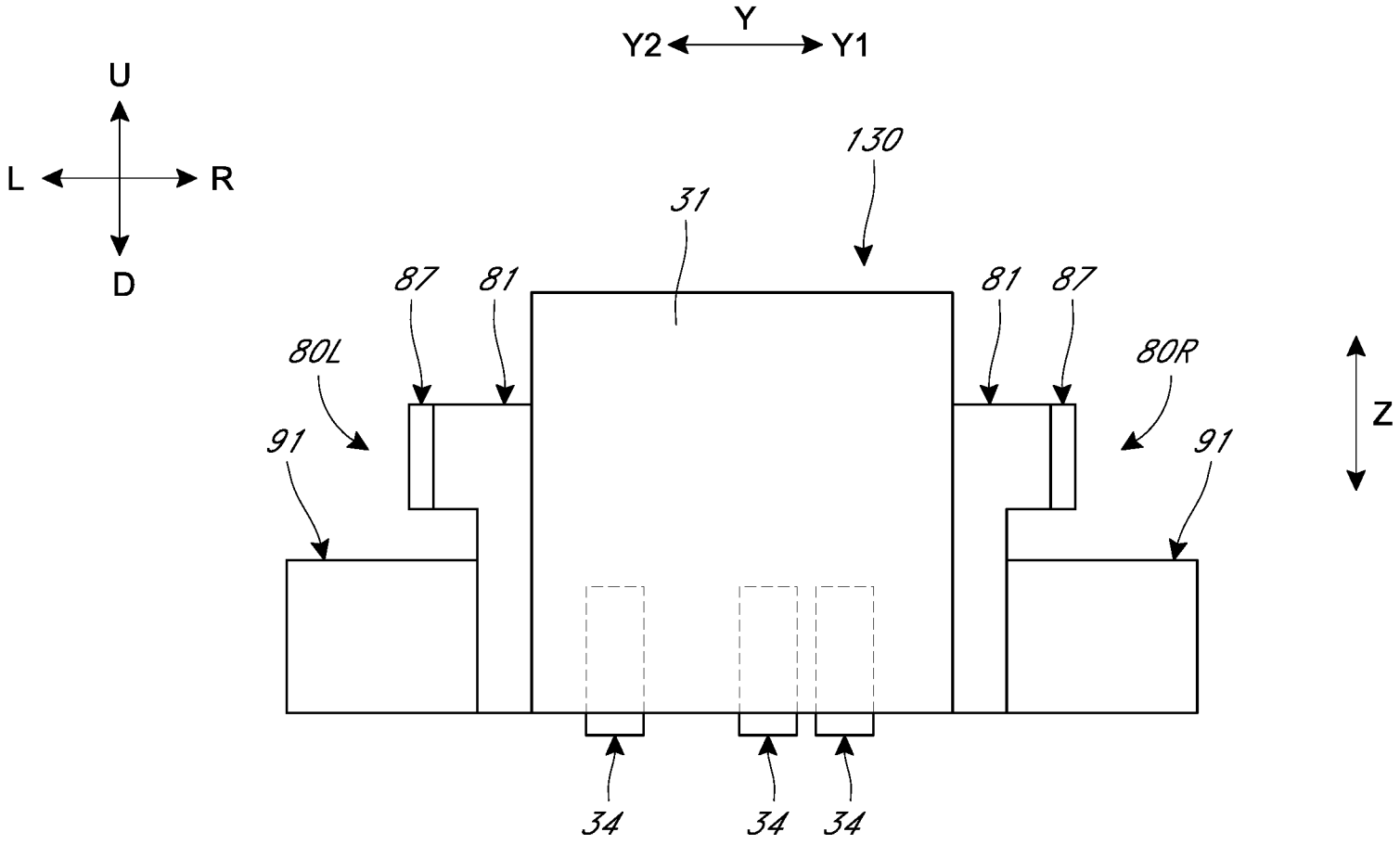
FIG. 10 is a front elevational view of an ink head unit according to another embodiment.

For example, with reference to FIG. 10, the structure may instead be one wherein ink is discharged from the ink head 34 toward the printing medium 5 during movement in the outbound direction Y1 and the return direction Y2. In this case, the ink head unit 130 can be equipped with a left side blowing device 80L that is disposed further to the left than the ink head 34, and a right side blowing device 80R that is disposed further to the right than the ink head 34, as depicted in FIG. 10. The left side blowing device 80L is disposed behind the ink head 34 in the outbound direction Y1. The right side blowing device 80R is disposed behind the ink head 34 in the return direction Y2. The structure of the left side blowing device 80L can be identical to that of the blowing device 80, described above. Moreover, the structure of the right side blowing device 80R can be identical to that of the left side blowing device 80L, with the exception of the point that it would be disposed with left/right symmetry with the left side blowing device 80L, in respect to the head carriage 32. Here the first fan 87 and second fan 97 of the left side blowing device 80L would be driven when ink is discharged toward the printing medium 5 from the nozzle 35 of the ink head 34 while the head carriage 32 is moving in the outbound direction Y1. On the other hand, the first fan 87 and second fan 97 of the right side blowing device 80R would be driven when ink is discharged toward the printing medium 5 from the nozzle 35 of the ink head 34 while the head carriage 32 is moving in the return direction Y2.

The technology disclosed here can be applied to a variety of printers. In addition to the printer 10 of a flatbed type, described in the embodiment set forth above, it may be applied in the same way also to a printer 10 of a roll-to-roll type, wherein a rolled printing medium 5 is fed in the secondary scanning direction X.

What is claimed is:

1. An inkjet printer, comprising:

a placement platform on which a printing medium is placed;

an ink head, positioned higher than the placement platform, for discharging ink toward the printing medium that is placed on the placement platform;

a carriage on which the ink head is mounted, able to move in a primary scanning direction; and a blowing device, mounted on the carriage, for blowing air against the printing medium, wherein:

the blowing device comprises:

a first case that has a first air intake opening, which faces the printing medium, for taking in air from a vicinity of the printing medium, and a first outlet opening, which is positioned higher than the first air intake opening, for expelling the air that is taken in from the first air intake opening, where the first case is disposed further rearward than the ink head in a direction of movement of the ink head when the ink is discharged toward the printing medium from the ink head;

a first fan, provided in the first case, for drawing in air from the first air intake opening and expelling the air from the first outlet opening;

a first filter, disposed within the first case so as to be positioned between the first air intake opening and the first outlet opening, through which the air that is drawn in from the first air intake opening passes;

a second case, having a second air intake opening that faces upward and a second outlet opening that faces the printing medium and that expels, toward the printing medium, the air taken in from the second air intake opening, where the second case is positioned further rearward, in the direction of movement, than the first air intake open; and a second fan, provided in the second case, for drawing in air from the second air intake opening and expelling the air from the second outlet opening toward the printing medium.

2. An inkjet printer as set forth in claim 1, wherein the magnitude of the airflow for the first fan is less than the magnitude of the airflow for the second fan.

3. An inkjet printer as set forth in claim 1, wherein the blowing device comprises a second filter, disposed within the second case so as to be positioned between the second air intake opening and the second outlet opening, through which the air that is drawn in from the second air intake opening passes.

4. An inkjet printer as set forth in claim 1, wherein the first outlet opening is positioned higher than the ink head.

5. An inkjet printer as set forth in claim 1, further comprising:

a damper, provided on a top of the ink head, for storing ink temporarily, wherein:

the first outlet opening is positioned higher than the damper.

6. An inkjet printer as set forth in claim 1, wherein:

a length of the first air intake opening in a secondary scanning direction, which is perpendicular to the primary scanning direction is longer than a length of the ink head in the secondary scanning direction.

7. An inkjet printer as set forth in claim 1, wherein a length of the second outlet opening in a secondary scanning direction, which is perpendicular to the primary scanning direction is longer than a length of the ink head in the secondary scanning direction.

8. An inkjet printer as set forth in claim 1, wherein:

the second air intake opening is positioned lower than the first outlet opening and further rearward, in the direction of movement, than the first outlet opening; and a straight line through a center of the first outlet opening overlaps, in a plan view, the second air intake opening.

9. An inkjet printer as set forth in claim 1, wherein:

an end portion of an upstream side of the second air intake opening in a secondary scanning direction that is perpendicular to the primary scanning direction is positioned further toward the upstream side in the secondary scanning direction than an end portion of an upstream side, in the secondary scanning direction, of the first outlet opening; and an end portion of a downstream side of the second air intake opening in a secondary scanning direction is positioned further toward the downstream side in the secondary scanning direction than an end portion of a downstream side, in the secondary scanning direction, of the first outlet opening.

10. An inkjet printer as set forth in claim 1, wherein the direction along which air is drawn into the first air intake opening is perpendicular to the printing medium.

11. An inkjet printer as set forth claim 1, wherein the direction in which air is expelled from the second outlet opening is in a direction away from the ink head, in the primary scanning direction, and downward.

12. An inkjet printer as set forth in claim 1, wherein the blowing device comprises a heating mechanism, disposed within the second case, for heating the air that is to be expelled from the second outlet opening.

13. An inkjet printer, comprising:

a placement platform configured to support a printing medium;

an ink head, positioned higher than the placement platform, and configured to discharge ink toward the printing medium supported on the placement platform, in use;

a carriage supporting the ink head is mounted, the carriage being configured to move in a primary scanning direction; and a blower device, mounted on the carriage, the blower device being configured to blow air against the printing medium, the blower device comprising:

a first case including a first air intake opening and a first outlet opening, the first air intake opening oriented to face toward the placement platform so as to face toward the printing medium in use, the first air intake positioned to take in air from a vicinity of the printing medium in use, the first outlet opening being positioned higher than the first air intake opening, the first outlet opening configured to expel the air that is taken in from the first air intake opening, wherein the first case is disposed further rearward than the ink head in a printing direction of movement of the ink head when ink is discharged from the ink head, toward the printing medium;

a first fan disposed in the first case and configured to drawing in air through the first air intake opening and to expel the air from the first outlet opening;

a first filter, disposed within the first case between the first air intake opening and the first outlet opening such that the air drawn in from the first air intake opening passes through the first filter before being expelled through the first outlet opening;

a second case having a second air intake opening that faces upward and a second outlet opening that faces toward the printing medium, the second outlet being configured to expel the air drawn in through the second air intake, toward the printing medium in use, wherein the second case is positioned further rearward, in the printing direction of movement, than the first air intake open; and a second fan disposed in the second case and configured to draw in air through the second air intake opening and to expel the air from the second outlet opening toward the printing medium, in use.

14. An inkjet printer as set forth in claim 13, wherein a first magnitude of airflow for the first fan is less than a second magnitude of airflow for the second fan.

15. An inkjet printer as set forth in claim 13, wherein the blower device comprises a second filter disposed within the second case, positioned between the second air intake opening and the second outlet opening such that air that is drawn in from the second air intake opening passes through the second filter.

16. An inkjet printer as set forth in claim 13, wherein the first outlet opening is positioned higher than the ink head.

17. An inkjet printer as set forth in claim 13, further comprising a damper positioned on a top of the ink head and being configured to store ink temporarily, wherein the first outlet opening is positioned higher than the damper.

18. An inkjet printer as set forth in claim 13, wherein a length of the first air intake opening along a secondary scanning direction perpendicular to the primary scanning direction, is longer than a length of the ink head along the secondary scanning direction.

19. An inkjet printer as set forth in claim 13, wherein a length of the second outlet opening along a secondary scanning direction perpendicular to the primary scanning direction, is longer than a length of the ink head along the secondary scanning direction.

20. An inkjet printer as set forth in claim 13, wherein the blower device comprises a heater disposed within the second case, the heater being configured to heat air prior to being expelled through the second outlet opening.

* * * * *